United States Patent [19]

Morrow et al.

[11] 4,418,119

[45] Nov. 29, 1983

[54] OVENABLE BOARD

[75] Inventors: George W. Morrow; Phillip R. Lambert, Cullman, both of Ala.

[73] Assignee: Daubert Industries, Inc., Oak Brook, Ill.

[21] Appl. No.: 322,437

[22] Filed: Nov. 18, 1981

[51] Int. Cl.[3] ..... B32B 9/04; B05D 3/02

[52] U.S. Cl. ..... 428/342; 206/484.2; 206/524.2; 427/387; 427/411; 428/447; 428/514; 428/537; 493/330

[58] Field of Search ..... 427/387, 411; 493/110, 493/148, 328, 330; 206/484.2, 524.2; 428/341, 342, 447, 514, 537

[56] References Cited

U.S. PATENT DOCUMENTS

| | | | |
|---|---|---|---|
| 2,251,296 | 8/1941 | Shipp | 427/411 X |
| 3,223,579 | 12/1965 | Dorland et al. | 162/123 X |
| 3,463,661 | 8/1969 | Benson | 427/411 X |
| 3,493,419 | 2/1970 | Jones et al. | 428/537 X |
| 4,288,497 | 9/1981 | Tanaka et al. | 428/447 |
| 4,304,815 | 12/1981 | Cugasi, Jr. | 428/537 X |

*Primary Examiner*—Thurman K. Page

*Attorney, Agent, or Firm*—Wallenstein, Wagner, Hattis, Strampel & Aubel

[57] ABSTRACT

Ovenable board comprising a paperboard or the like, base material having a coating of polyvinyl alcohol and a silicone. The ovenable board is especially adapted for use in packaging pre-prepared food products such as pizza and bakery goods.

2 Claims, No Drawings

OVENABLE BOARD

This invention relates to an ovenable board having special utility as a packaging material for pre-prepared food products.

Heretofore, packaging material employed for pre-prepared, or convenience food products such as pizza and bakery goods has been provided with a grease and oil resistant plastic film, usually MYLAR, or has been coated with a latex based composition which is grease and oil resistant. The latex based coating generally has an overlayer of a silicone. While plastic films, such as MYLAR, are convenient to use in that they can be readily extruded onto the surface of a paperboard base material, for example, the plastic film does not release easily from stickier foods having a high sugar content, or from pizza dough. Over and above their unsatisfactory release properties, plastic films of the type mentioned are relatively expensive, and require specialized equipment to apply. These factors add significantly to the cost of manufacturing ovenable board utilizing such films. Latex based compositions employed for providing a grease and oil resistant coating on ovenable board are characterized in that their depth of penetration into a paper substrate such as paperboard is inadequate, a condition which tends to cause cracks to develop when plates are formed from the paper substrate. A further, and much more serious shortcoming of latex type coating materials, is the tendency of surfactants employed in formulating the latices to be imbibed or absorbed by food products packaged in ovenable board coated with the latex.

In accordance with the present invention, an ovenable board has been evolved which overcomes all of the aforementioned shortcomings of ovenable boards utilizing plastic films or latex based materials as coatings. Not only does the ovenable board of the present invention have excellent grease and oil resistant properties, but also, the depth of the coatings comprising the board is such that the coatings are easily capable of withstanding the forces encountered by the ovenable board during plate formation without any adverse effects whatsoever. Furthermore, the ovenable board of this invention can be manufactured at an appreciably lower cost than an ovenable board employing plastic films such as MYLAR, while at the same time providing an ovenable board which is completely safe for use with food products.

The invention, in brief, comprises a paper or paperboard substrate having a coating thereon of polyvinyl alcohol, the coating of polyvinyl alcohol, in turn, advantageously being provided with a release coating comprising a silicone. The polyvinyl alcohol manifests excellent penetration characteristics while acting as an excellent base for a silicone coating. The ovenable board of this invention is pin hole free and, as stated, can withstand the forces applied thereto during processing without damaging in any way the integrity of the coatings thereon. The coating compositions used in making the ovenable board contain no ingredients which can be absorbed or imbibed by packaged food products in contact with the board. In addition, the ovenable board of this invention can withstand temperatures in the range of from about 0° F. to about 350° F. without any adverse affect on the board or the coatings comprising the board.

The paper, paperboard, or the like, substrate employed in manufacturing the ovenable board can be the type used in the manufacture of conventional ovenable board. Exemplary of one such substrate is the paperboard product sold under the designation "PRESSWARE" (International Paper Company).

The polyvinyl alcohol used in forming the ovenable board of this invention can be any of a number of commericially available products. A particularly preferred product is the polyvinyl alcohol product sold under the trade designation "ELVANOL" (E. I. DuPont Company). The polyvinyl alcohol desirably is used in the form of an aqueous solution containing from about 5% to about 12%, preferably from about 8% to about 10% solids. The solution may be applied to the substrate material in any manner known in the art. In accordance with a preferred practice of the invention, the polyvinyl alcohol is applied with a #7 rod and then dried for approximately 1 minute at a temperature of about 300° F. To insure a proper level of take-up by the substrate material, it may be desirable to apply a second coating of the polyvinyl alcohol solution in the same manner. While the loadings of polyvinyl alcohol in the substrate material may vary somewhat, the polyvinyl alcohol advantageously is applied in an amount sufficient to provide loadings of the order of about 3 to about 12, preferably from about 7 to about 10 pounds per ream.

Following the application of the polyvinyl alcohol coating to the paperboard base material, a solution of a silicone is overcoated on the polyvinyl alcohol coating. Again, various silicone materials can be used for this purpose. Exemplary of one such product is the silicone sold under the designation "SS 4191" (General Electric Company). The silicone desirably is applied in the form of a solvent solution consisting of from about 3% to about 10% solids. In utilizing a silicone such as SS 4191, the material is first stirred into a suitable solvent solution comprising, for example, a mixture of heptane and toluene. A catalyst and an accelerator are then added. The resulting solution is applied to the polyvinyl alcohol coated substrate by means of a rod, and is then dried and cured at a temperature in the range of from about 300° F. to about 325° F. The quantity of silicone overcoat applied should be sufficient to provide loadings of the silicone in the range of from about 0.5 to about 0.10, preferably from about 0.7 to about 0.9 pounds per ream of substrate material. After the silicone coating has been dried and cured, the finished board is ready to be formed into plates, or the like, for use in packaging food products.

The following example is illustrative of a method making the ovenable board of the present invention.

EXAMPLE

An aqueous polyvinyl alcohol (ELVANOL) solution comprising 8% solids was coated on Pressware paperboard with a #7 rod. The coating was dried in an oven for 1 minute at a temperature of 300° F. at a line speed of about 200 feet per minute. A second coating of the same solution was applied in the same manner, and dried in an oven for 1 minute at 300° F. at the same line speed. A silicone solution having the following formulation,

| | |
|---|---|
| Heptane | 229 pounds |
| Toluene | 26 pounds |
| SS4191 (GE) | 51 pounds |

-continued

| | |
|---|---|
| SS4259C catalyst (GE) | 1300 cc |
| SS4192C accelerator (GE) | 1275 cc |

was applied to the polyvinyl alcohol coated paperboard with a #5 rod. The silicone coating was dried and cured at a temperature of 325° F. in an oven at a line speed of about 125 feet per minute. The finished ovenable board showed excellent resistance to grease and oil, and easily released from pizza dough. The board was subjected to creasing to simulate the forces encountered during plate formation with no apparent change in the integrity of the coatings comprising the board.

What is claimed is:

1. An ovenable board for packaging of pizza comprising a paperboard substrate material having two discrete coatings palced thereon, the first coating comprising at least one addition to the surface of said substrate of a coating of polyvinyl alcohol, said polyvinyl alcohol being present on the paper substrate material in an amount in the range of from about 3 to about 12 pounds per ream of said paperboard substrate and a second coating comprising a layer of a silicone release coating being placed on the exposed surface of said first coating of polyvinyl alcohol, said second coating being present on the surface of said first coating comprising polyvinyl alcohol in an amount in the range of from about 0.7 to about 0.9 pounds per ream of said paperboard substrate and being inert to and not absorbed by the components of said pizza which are in contact with said second coating, that their integrity is unaffected at temperatures ranging from about 0° F. to about 350° F.

2. A method of making an ovenable board which comprises:

(a) applying an aqueous solution of a first coating substrate comprising polyvinyl alcohol to a paperboard substrate material, drying said paperboard substrate material at a temperature of from about 300° F. to about 350° F. to provide a loading of said first polyvinyl coating on the dried paperboard substrate material of the order of from about 3 to about 12 pounds of polyvinyl alcohol per ream of said paperboard substrate material;

(b) then applying a second solution comprising a silicone and a silicone catalyst to the first substrate coating of polyvinyl alcohol, which is coated to said paperboard substrate material, said silicone being applied until the same is present in an amount sufficient to provide a loading of said silicone to said polyvinyl first coating substrate of from about 0.7 to about 0.9 pounds per ream of said paperboard substrate material; and (c) drying and curing the silicone second substrate at a temperature of about 325° F.

* * * * *